US007649437B2

(12) United States Patent
Mihara et al.

(10) Patent No.: US 7,649,437 B2
(45) Date of Patent: Jan. 19, 2010

(54) MULTILAYER POSITIVE TEMPERATURE COEFFICIENT THERMISTOR

(75) Inventors: Kenjirou Mihara, Higashiomi (JP); Atsushi Kishimoto, Kusatsu (JP); Hideaki Niimi, Hikone (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 12/049,671

(22) Filed: Mar. 17, 2008

(65) Prior Publication Data

US 2008/0204186 A1 Aug. 28, 2008

Related U.S. Application Data

(63) Continuation of application No. PCT/JP2006/318631, filed on Sep. 20, 2006.

(30) Foreign Application Priority Data

Sep. 20, 2005 (JP) ..... 2005-272485

(51) Int. Cl.
*H01C 7/10* (2006.01)

(52) U.S. Cl. ..... 338/22 R; 338/13; 338/260; 338/328

(58) Field of Classification Search ..... 338/22 R, 338/13, 22 SD, 260, 307, 328
See application file for complete search history.

(56) References Cited

U.S. PATENT DOCUMENTS 6,911,102 B2 * 6/2005 Niimi ..... 156/89.14
7,295,421 B2 * 11/2007 Mihara et al. ..... 361/308.1

FOREIGN PATENT DOCUMENTS

JP 06-302403 10/1994

(Continued)

OTHER PUBLICATIONS

PCT/JP2006/318631 International Search Report dated Dec. 19, 2006.

(Continued)

*Primary Examiner*—Kyung Lee
(74) *Attorney, Agent, or Firm*—Dickstein Shapiro LLP

(57) ABSTRACT

A multilayer positive temperature coefficient thermistor that has a $BaTiO_3$-based ceramic material contained as a primary component in semiconductor ceramic layers, the ratio of the Ba site to the Ti site is in the range of 0.998 to 1.006, and at least one element selected from the group consisting of La, Ce, Pr, Nd, and Pm is contained as a semiconductor dopant. In this multilayer positive temperature coefficient thermistor, a thickness d of internal electrodes layer and a thickness D of the semiconductor ceramic layers satisfy $d \geqq 0.6$ μm and $d/D<0.2$. Accordingly, even when the semiconductor ceramic layers have a low sintered density such that an actual-measured sintered density is 65% to 90% of a theoretical sintered density, a multilayer positive temperature coefficient thermistor having a low rate of temporal change in room-temperature resistance can be obtained without performing any complicated processes, such as a heat treatment. When the content of the semiconductor dopant is 0.1 to 0.5 molar parts with respect to 100 molar parts of Ti, a low-temperature firing at 1,150° C. can be realized, and a low room-temperature resistance and a sufficiently high rate of resistance change can be obtained.

10 Claims, 1 Drawing Sheet

FOREIGN PATENT DOCUMENTS

| | | |
|---|---|---|
| JP | 07-014702 | 1/1995 |
| JP | 2001-031471 | 2/2001 |
| JP | 2001-052904 | 2/2001 |
| JP | 2001-130957 | 5/2001 |
| JP | 2001-167906 | 6/2001 |
| JP | 2001-203102 | 7/2001 |
| JP | 2004-063548 | 2/2004 |
| JP | 2004-134744 | 4/2004 |
| JP | 2005-093574 | 4/2005 |
| WO | WO 2004/075216 | 9/2004 |

OTHER PUBLICATIONS

PCT/JP2006/318631 Written Opinion dated Dec. 19, 2006.

* cited by examiner

MULTILAYER POSITIVE TEMPERATURE COEFFICIENT THERMISTOR

CROSS REFERENCE TO RELATED APPLICATIONS

The present application is a continuation of International Application No. PCT/JP2006/318631, filed Sep. 20, 2006, which claims priority to Japanese Patent Application No. JP2005-272485, filed Sep. 20, 2005, the entire contents of each of these applications being incorporated herein by reference in their entirety.

FIELD OF THE INVENTION

The present invention relates to a multilayer positive temperature coefficient thermistor used for overcurrent protection, temperature detection, and the like, and more particularly relates to a multilayer positive temperature coefficient thermistor which improves the rate of temporal change in room-temperature resistance.

BACKGROUND OF THE INVENTION

In recent years, the sizes of electronic devices have been progressively downsized, and concomitant therewith, the downsizing in size of positive temperature coefficient thermistors mounted in the above-mentioned electronic devices has also been implemented. The positive temperature coefficient thermistor described above has a positive resistance temperature characteristic, and as a downsized positive temperature coefficient thermistor, for example, a multilayer positive temperature coefficient thermistor is known.

This type multilayer positive temperature coefficient thermistor described above generally has a ceramic body which includes a plurality of semiconductor ceramic layers each having a positive resistance temperature characteristic and a plurality of internal electrode layers formed along interfaces between the semiconductor ceramic layers, the internal electrode layers are alternately extended to two end portions of the ceramic body, and external electrodes are also formed so as to be electrically connected to the internal electrode layers thus extended. In addition, as the semiconductor ceramic layer, a material primarily containing a $BaTiO_3$-based ceramic material is used. Furthermore, in order to obtain a positive resistance temperature characteristic by a $BaTiO_3$-based ceramic material, an extremely small amount of a semiconductor dopant is added thereto, and as this semiconductor dopant, in general, samarium (Sm) has been widely used.

In addition, as an internal electrode material used in the multilayer positive temperature coefficient thermistor, Ni has been widely used. In general, the ceramic body of the multilayer positive temperature coefficient thermistor is formed by the steps of performing screen printing of an internal electrode conductive paste on ceramic green sheets to be formed into the semiconductor ceramic layers to form conductive patterns, laminating the ceramic green sheets provided with the conductive patterns in a predetermined order, and simultaneously firing the ceramic green sheets and the conductive patterns.

Moreover, when Ni is used as the internal electrode material, the simultaneous firing must be performed in a reducing atmosphere since Ni is oxidized when simultaneous firing is performed in an air atmosphere. However, when the simultaneous firing is performed in a reducing atmosphere, the semiconductor ceramic layers are also reduced. As a result, a sufficient rate of resistance change cannot be obtained.

Accordingly, in general, after the simultaneous firing is performed in a reducing atmosphere, a re-oxidation treatment is additionally performed in an air atmosphere or in an oxygen atmosphere.

However, in this re-oxidation treatment, a heat treatment temperature is difficult to control, and it is not easy to diffuse oxygen sufficiently to a central portion of the ceramic body; hence, oxidation is irregularly performed thereby, and as a result, a sufficient rate of resistance change may not be obtained in some cases.

Accordingly, in Patent Document 1, a multilayer positive temperature coefficient thermistor has been proposed in which a void ratio of semiconductor ceramic layers is set in the range of 5 to 40 percent by volume, and among thermistor layers, which are effective layers provided between two internal electrodes located at the outermost sides in the lamination direction, the void ratio of a thermistor layer located at a central portion in the lamination direction is higher than that of a thermistor layer located outside in the lamination direction.

According to the Patent Document 1, although the void ratio of the semiconductor ceramic layers are set in the range of 5 to 40 percent by volume, when this void ratio is converted into a sintered density, the sintered density thus converted approximately corresponds to 60% to 95% of a theoretical sintered density. In addition, according to this Patent Document 1, an actual-measured sintered density of the semiconductor ceramic layers is decreased to 60% to 95% of the theoretical sintered density, and the void ratio of the thermistor layer located at the central portion is increased larger than that of the thermistor layer located outside, so that oxygen can be easily diffused sufficiently to the central portion of the ceramic body; hence, as a result, by preventing the generation of irregular oxidation, it is intended to obtain a desired rate of resistance change.

On the other hand, after ceramic green sheets to be formed into the semiconductor ceramic layers and conductive patterns to be formed into the internal electrode layers are simultaneously fired in a reducing atmosphere, heat treating is performed in an air atmosphere or an oxygen atmosphere. Since many thermal and atmospheric histories are applied to the semiconductor ceramic layers, strains are generated therein. As a result, the rate of temporal change in room-temperature resistance may be increased in some cases.

Accordingly, as a method for decreasing the rate of temporal change in room-temperature resistance described above, as disclosed in Patent Document 2, a method for manufacturing a multilayer positive temperature coefficient thermistor has been proposed in which a heat treatment is performed on a ceramic body provided with external electrodes at a temperature of 60 to 200° C.

In this Patent Document 2, by performing the heat treatment at a temperature of 60 to 200° C. after the external electrodes are formed on the ceramic body, it is attempted to gradually reduce the strains generated in the semiconductor ceramic layers and to stabilize the rate of temporal change in room-temperature resistance.

Patent Document 1: Japanese Unexamined Patent Application Publication No. 2005-93574

Patent Document 2: Japanese Unexamined Patent Application Publication No. 2004-134744

According to the manufacturing method disclosed in the Patent Document 2, the heat treatment is performed at a temperature of 60 to 200° C. However, in order to stabilize the rate of temporal change in room-temperature resistance, it is believed that a heat treatment for approximately 100 hours be required (see paragraph [0023] of the Patent Document 2).

Hence, the heat treatment takes a long period of time, and the production efficiency is degraded, and a problem of inferior mass productivity may be caused.

In addition, as disclosed in the Patent Document 1, in the case in which Sm is used as the semiconductor dopant, when the sintered density of the semiconductor ceramic layer is low, the inter-particle bond thereof is also weak, and the crystal lattice becomes unstable; hence, even when the heat treatment is performed as disclosed in the Patent Document 2, it is difficult to sufficiently stabilize the rate of temporal change in room-temperature resistance.

SUMMARY OF THE INVENTION

The present invention has been conceived in consideration of the above situation, and an object of the present invention is, even when semiconductor ceramic layers are used which are primarily composed of a $BaTiO_3$-based ceramic material and which have a low sintered density, to provide a multilayer positive temperature coefficient thermistor having a low rate of temporal change in room-temperature resistance without performing any complicated processes such as a heat treatment.

In order to achieve the above object, through intensive research carried out by the inventors of the present invention, the following insight was obtained. That is, even in the case in which semiconductor ceramic layers include a $BaTiO_3$-based ceramic material as a primary component, and an actual-measured sintered density is low in the range of 65% to 90% of a theoretical sintered density, the ratio of the Ba site to the Ti site is set in the range of 0.998 to 1.006, a specific substance such as La or Ce, is contained as a semiconductor dopant, a thickness d of internal electrode layers is set to 0.6 μm or more, and d/D, which is the ratio between the thickness d and a thickness D of the semiconductor ceramic layers, is set to less than 0.2, the generation of strain can be suppressed even if the internal electrode layers and the semiconductor ceramic layers are formed by simultaneous firing in a reducing atmosphere and are further processed by a re-oxidation treatment, and as a result, the rate of temporal change in room-temperature resistance can be decreased.

The present invention was made based on the insight described above, and a multilayer positive temperature coefficient thermistor of the present invention comprises: a ceramic body in which semiconductor ceramic layers having an actual-measured sintered density in the range of 65% to 90% of a theoretical sintered density and internal electrode layers are alternately laminated to each other and are sintered; and external electrodes formed on two end portions of the ceramic body so as to be electrically connected to the internal electrode layers. According to the above multilayer positive temperature coefficient thermistor, in the semiconductor ceramic layers, a $BaTiO_3$-based ceramic material is contained as a primary component, the ratio of the Ba site to the Ti site is $0.998 \leqq$ Ba site/Ti site $\leqq 1.006$, and at least one element selected from the group consisting of La, Ce, Pr, Nd, and Pm is contained as a semiconductor dopant, and a thickness d of the internal electrode layers and a thickness D of the semiconductor ceramic layers satisfy $D \geqq 0.6$ and $d/D<0.2$.

In addition, through further intensive research carried out by the inventors of the present invention, it was found that when the addition amount of the semiconductor dopant is set in the range of 0.1 to 0.5 molar parts with respect to 100 molar parts of Ti of the $BaTiO_3$-based ceramic material, the sintering properties can be improved, and even when firing is performed at a lower temperature, the room-temperature resistance can be decreased while a high rate of resistance change is maintained.

That is, in the multilayer positive temperature coefficient thermistor of the present invention, the semiconductor dopant is contained in the range of 0.1 to 0.5 molar parts with respect to 100 molar parts of Ti of the $BaTiO_3$-based ceramic material.

According to the multilayer positive temperature coefficient thermistor described above, since in the semiconductor ceramic layers, the $BaTiO_3$-based ceramic material is contained as a primary component, the ratio of the Ba site to the Ti site is $0.998 \leqq$ Ba site/Ti site $\leqq 1.006$, and at least one element selected from the group consisting of La, Ce, Pr, Nd, and Pm is contained as the semiconductor dopant, and since the thickness d of the internal electrode layers and the thickness D of the semiconductor ceramic layers satisfy $D \geqq 0.6$ and $d/D<0.2$, even when the actual-measured sintered density of the semiconductor ceramic layers is low in the range of 65% to 90% of the theoretical sintered density, the strain can be reduced without performing a long heat treatment, and a multilayer positive temperature coefficient thermistor having a low rate of temporal change in room-temperature resistance can be obtained.

In addition, since the semiconductor dopant is contained in the range of 0.1 to 0.5 molar parts with respect to 100 molar parts of Ti of the $BaTiO_3$-based ceramic material, the firing temperature can be decreased, and even when sintering is performed at a lower temperature, the room-temperature resistance can be decreased while a high rate of resistance change is maintained. Hence, a multilayer positive temperature coefficient thermistor can be obtained which has a low rate of temporal change in room-temperature resistance, and which further has a high rate of resistance change and a low room-temperature resistance.

REFERENCE NUMERALS

Figure 1:
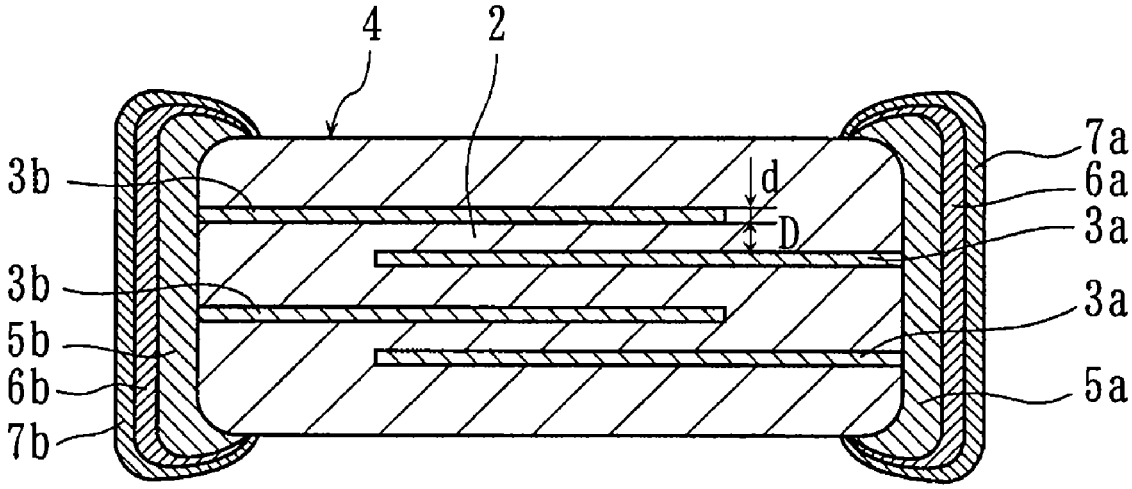
FIG. 1 is a schematic cross-sectional view schematically showing one embodiment of a multilayer positive temperature coefficient thermistor of the present invention.

2 semiconductor ceramic layer
3*a*, 3*b* internal electrode layer
4 ceramic body
5*a*, 5*b* external electrode

DETAILED DESCRIPTION OF THE INVENTION

Next, an embodiment of the present invention will be described in detail.

FIG. 1 is a schematic cross-sectional view schematically showing one embodiment of a multilayer positive temperature coefficient thermistor of the present invention.

In this multilayer positive temperature coefficient thermistor, internal electrode layers 3*a* and 3*b* are embedded in a ceramic body 4 having semiconductor ceramic layers 2. In addition, external electrodes 5*a* and 5*b* are formed on two end portions of the ceramic body 4 so as to be electrically connected to the internal electrode layers 3*a* and 3*b*. That is, the internal electrode layers 3*a* and the internal electrode layers 3*b* are formed so as to be alternately extended to one end surface of the ceramic body 4 and the other end surface thereof. Furthermore, the external electrode 5*a* is electrically connected to the internal electrode layers 3*a*, and the external electrode 5*b* is electrically connected to the internal electrode layers 3*b*.

In addition, first plating films 6*a* and 6*b* composed of Ni or the like are formed on the surfaces of the external electrodes 5*a* and 5*b*, and second plating films 7*a* and 7*b* composed of Sn or the like are further formed on the surfaces of the first plating films 6*a* and 6*b*.

In addition, the semiconductor ceramic layers 2 are formed so as to have an actual-measured sintered density in the range of 65% to 90% of a theoretical sintered density.

That is, when the actual-measured sintered density is less than 65% of the theoretical sintered density, since the sintered density is too low, the mechanical strength of the ceramic body 4 is decreased, and/or the room-temperature resistance thereof is increased. On the other hand, when the actual-measured sintered density is more than 90% of the theoretical sintered density, since the sintered density is excessively high, it becomes difficult to diffuse oxygen sufficiently to a central portion of the ceramic body 4 during a re-oxidation treatment, and the re-oxidation treatment is not smoothly performed. Hence, as a result, a sufficient rate of resistance change cannot be obtained, and the rate of temporal change in room-temperature resistance is also increased.

On the other hand, when the actual-measured sintered density of the semiconductor ceramic layer 2 is in the range of 65% to 90% of the theoretical sintered density, without causing degradation in mechanical strength, oxygen can be sufficiently diffused to the central portion of the ceramic body 4 during the re-oxidation treatment, and as a result, a multilayer positive temperature coefficient thermistor having a sufficient rate of resistance change can be obtained. Furthermore, the rate of temporal change in room-temperature resistance can be maintained at a low level.

In the semiconductor ceramic layer 2, regarding composition, a $BaTiO_3$-based ceramic material having a perovskite structure (general formula: $ABO_3$) is contained as a primary component, and as a semiconductor dopant, at least one element selected from the group consisting of La, Ce, Pr, Nd, and Pm is contained; hence, as a result, a decrease in rate of temporal change in room-temperature resistance is realized.

In particular, the $BaTiO_3$-based ceramic material contained as a primary component is formed so that the ratio of the B site to the Ti site (=Ba site/Ti site) is in the range of 0.998 to 1.006.

That is, when the Ba site/Ti site is less than 0.998, the rate of temporal change in room-temperature resistance is increased, and the room-temperature resistance is also increased. On the other hand, also when the Ba site/Ti site is more than 1.006, the rate of temporal change in room-temperature resistance is increased, and the room-temperature resistance is also increased. In particular, when storage is performed for a long period of time under high-temperature and high-humidity conditions (for example, at a temperature of 60° C. and a humidity of 85% to 90%), the rate of temporal change in room-temperature resistance is increased.

Accordingly, in this embodiment, the amounts of individual composition are adjusted so that the Ba site/Ti site is in the range of 0.998 to 1.006.

In $BaTiO_3$ represented by the general formula $ABO_3$, the Ba site indicates the entire A sites at which Ba atoms are coordinated. Hence, in this embodiment, the above semiconductor dopant atoms replace some of the Ba atoms and are coordinated at A sites, and hence the Ba site includes sites at which, besides the Ba atoms, the above semiconductor dopant and other replacing elements are coordinated. In the same manner as described above, the Ti site indicates the entire B sites at which Ti atoms are coordinated, and hence, the Ti site includes sites at which, besides the Ti atoms, replacing elements are coordinated.

In addition, as the semiconductor dopant contained in the semiconductor ceramic layer 2, La, Ce, Pr, Nd, and Pm (hereinafter, these semiconductor dopants are collectively referred to as the "specific semiconductor dopant") are limited by the following reasons.

As disclosed in the Patent Document 1, Sm has been generally used as a semiconductor dopant in this type of multilayer positive temperature coefficient thermistor; however, when Sm is used as a semiconductor dopant, the rate of temporal change in room-temperature resistance tends to increase. The reason for this is believed that since Sm is liable to be solid-solved in both the Ba site and the Ti site, when influence of a thermal and/or an atmospheric history is generated, strain is liable to be generated in a ceramic crystal lattice.

On the other hand, it was found from the research results obtained by the inventors of the present invention that when the Ba site/Ti site is set in the range of 0.998 to 1.006, and when the above specific semiconductor dopant is used, since the specific semiconductor dopant is selectively solid-solved in the Ba site, the crystal lattice is likely to be stabilized thereby, and the strain of the ceramic can be reduced. That is, it is believed that when the Ba site/Ti site is set in the range of 0.998 to 1.006, and when the above specific semiconductor dopant is used, since the specific semiconductor dopant is selectively solid-solved in the Ba site, the crystal lattice of the semiconductor ceramic layer 2 is not likely to be distorted even when the actual-measured sintered density of the semiconductor ceramic layer 2 is low in the range of 65% to 90% of the theoretical sintered density, and as a result, the rate of temporal change in room-temperature resistance is decreased.

In addition, when the semiconductor dopant described above is contained in the semiconductor ceramic layer 2, the rate of temporal change in room-temperature resistance can be decreased; moreover, when the content is set in the range of 0.1 to 0.5 molar parts with respect to 100 molar parts of Ti, a low room-temperature resistance and a sufficient rate of resistance change can both be obtained, and hence it is more preferable.

In addition, it has been known that when conventional Sm is used as a semiconductor dopant, in order to obtain a low room-temperature resistance and a sufficiently high rate of resistance change, firing must be performed at a high temperature of 1,250° C. or more in a reducing atmosphere.

However, by further intensive research carried out by the inventors of the present invention, it was found that in the case in which the above specific semiconductor dopant in the range of 0.1 to 0.5 molar parts is contained in the semiconductor ceramic layer 2 with respect to 100 molar parts of Ti, even when firing is performed at a low firing temperature of 1,150° C. in a reducing atmosphere, while a sufficiently high rate of resistance change is maintained, the room-temperature resistance can be decreased.

In addition, since the rate of temporal change in room-temperature resistance can be decreased when the above semiconductor dopant is contained in the semiconductor ceramic layer 2, when the content of the specific semiconductor dopant is set in the range of 0.1 to 0.5 molar parts with respect to 100 molar parts of Ti, a multilayer positive temperature coefficient thermistor can be obtained which has a low rate of temporal change in room-temperature resistance and which further has a sufficiently high rate of resistance change and a low room-temperature resistance.

When the content of the specific semiconductor dopant is less than 0.1 molar parts with respect to 100 molar parts of Ti, since the amount of the semiconductor dopant is excessively small, semiconductorization cannot be sufficiently performed, and the room-temperature resistance may increase in some cases. On the other hand, when the content of the semiconductor dopant is more than 0.5 molar parts with respect to 100 molar parts of Ti, the room-temperature resistance also increases, and in this case, since the rate of resistance change may also decrease in some cases, it is not preferable in view of obtaining a low room-temperature resistance and a sufficiently high rate of resistance change.

In addition, in the multilayer positive temperature coefficient thermistor of this embodiment, the internal electrode layers 3*a* and 3*b* are formed to have a thickness d of 0.6 μm or more, and the ratio d/D of the thickness d of the internal electrode layers 3*a* and 3*b* to the thickness D of the semiconductor ceramic layer 2 is set to less than 0.2.

That is, when the thickness d of the internal electrode layers 3*a* and 3*b* is smaller than 0.6 μm, since contact areas between the internal electrode layers 3*a* and 3*b* and the external electrodes 5*a* and 5*b* are decreased, electrical connection becomes unstable thereby, and in addition, the rate of temporal change in room-temperature resistance also becomes unstable. In addition, when the ratio d/D of the thickness d of the internal electrode layers 3*a* and 3*b* to the thickness D of the semiconductor ceramic layer 2 is 0.2 or more, in the case in which the internal electrode layers 3*a* and 3*b* and the semiconductor ceramic layers 2 are sintered by simultaneous firing, strain is generated because of stresses generated between the internal electrode layers 3*a* and 3*b* and the semiconductor ceramic layers 2, and as a result, the rate of temporal change in room-temperature resistance may be increased in some cases.

On the other hand, when the thickness d of the internal electrode layers 3*a* and 3*b* is set to 0.6 μm or more, and the ratio d/D is set to less than 0.2, in the case in which the internal electrode layers and the semiconductor ceramic layers are sintered by simultaneous firing, the generation of structural strain can be suppressed.

Hence, in this embodiment, the thickness d of the internal electrode layers 3*a* and 3*b* is set to 0.6 μm or more, and the above ratio d/D is set to less than 0.2.

In addition, as an internal electrode layer material forming the internal electrode layers 3*a* and 3*b*, a material having superior ohmic contact with the semiconductor ceramic layer 2 is preferable, and for example, a base metal element, such as Ni, or Cu, or an alloy thereof is preferably used as a primary component.

In addition, as a material forming the external electrodes 5*a* and 5*b*, for example, a noble metal element and an alloy thereof, such as Ag, Ag—Pd, and Pd, or a base metal element, such as Ni or Cu, and an alloy thereof may be used, and a material having suitable connection to and conduction with the internal electrode layers 3*a* and 3*b* is preferably selected.

In the multilayer positive temperature coefficient thermistor described above, since (i) the ratio of the Ba site to the Ti site is set in the range of 0.998 to 1.006, (ii) the specific semiconductor dopant (La, Ce, Pr, Nd, and Pm) is contained in the semiconductor ceramic layer 2, and (iii) the thickness d of the internal electrode layers 3*a* and 3*b* and the above ratio d/D are set to 0.6 μm or more and less than 0.2, respectively, even when the actual-measured sintered density of the semiconductor ceramic layer 2 is low in the range of 65% to 90% of the theoretical sintered density, a multilayer positive temperature coefficient thermistor can be obtained in which the rate of temporal change in room-temperature resistance is low, and a structural strain is suppressed from being generated.

In particular, when the content of the semiconductor dopant is set in the range of 0.1 to 0.5 molar parts with respect to 100 molar parts of Ti of the $BaTiO_3$-based ceramic material, firing at a low temperature of 1,150° C. can be performed, and a high-quality multilayer positive temperature coefficient thermistor can be obtained in which the rate of temporal change in room-temperature resistance is low, and while a sufficiently high rate of resistance change is ensured, the room-temperature resistance is low.

Next, a method for manufacturing the above multilayer positive temperature coefficient thermistor will be described.

First, as starting materials, $BaCO_3$ and $TiO_2$ are prepared, and in addition, at least one of $La_2O_3$, $CeO_2$, $Pr_6O_{11}$, $Nd_2O_3$, and $Pm_2O_3$ is also prepared.

Subsequently, the above starting materials in predetermined amounts are weighed so as to obtain a ceramic composition represented by $(Ba_{1-\alpha}A_{\alpha})_xTi_yO_3$ (where A indicates at least one of La, Ce, Pr, Nd, and Pm, $0.998 \leqq x/y \leqq 1.006$ holds, and preferably $0.001 \leqq \alpha \leqq 0.005$ holds). Next, after the materials thus weighed are charged in a ball mill together with a pulverizing medium, such as partially stabilized zirconia (hereinafter referred to as "PSZ balls"), and are sufficiently processed by wet mixing and pulverizing, calcination is performed at a predetermined temperature (such as 1,000 to 1,200° C.), so that a ceramic powder is formed.

Next, an organic binder is added to the above ceramic powder, followed by performing a wet mixing treatment, so that a ceramic slurry is formed. Subsequently, the ceramic slurry thus obtained is formed into sheets by a sheet forming method, such as a doctor blade method, thereby forming ceramic green sheets.

In this step, the addition amount of the organic binder is adjusted so that the actual-measured sintered density of the semiconductor ceramic layer 2 after firing is in the range of 65% to 90% of the theoretical sintered density. In addition, the thickness of the ceramic green sheet is adjusted so that the relation between the thickness d of the internal electrode layers 3*a* and 3*b* and the thickness D of the semiconductor ceramic layer 2 after firing satisfies $d/D<0.2$.

Subsequently, an internal electrode conductive paste containing Ni as a primary component is prepared. Next, this internal electrode conductive paste is applied by screen printing or the like on the above ceramic green sheets, thereby forming conductive patterns. In addition, in this step, the coating thickness of the conductive pattern is adjusted so that the thickness d of the internal electrode layers 3*a* and 3*b* after firing is 0.6 μm or more, and so that the above d/D satisfies $d/D<0.2$.

Next, after the ceramic green sheets provided with the conductive patterns are laminated in a predetermined order, ceramic green sheets which are not provided with the conductive patterns are disposed at the top and the bottom, followed by pressure-bonding, so that a laminate is formed.

Subsequently, after this laminate is cut into a predetermined size and is then received in an alumina-made sagger, a de-binding treatment is performed at a predetermined temperature (such as 300 to 400° C.). Next, a firing treatment is performed in a predetermined reducing atmosphere (for example, the concentration of a $H_2$ gas to that of a $N_2$ gas is approximately 1 to 3 percent by weight) at a predetermined temperature (such as 1,100 to 1,300° C.), and as a result, the ceramic body 4 is formed in which the internal electrode layers 3*a* and 3*b* and the semiconductor ceramic layers 2 are alternately laminated to each other.

Subsequently, the ceramic body 4 described above is processed by a re-oxidation treatment in an air atmosphere or an oxygen atmosphere at a predetermined temperature (such as 500 to 700° C.).

Next, a sputtering treatment is performed on the two end portions of the ceramic body 4, so that the external electrodes 5*a* and 5*b* primarily composed of Ag are formed. Furthermore, on the surfaces of the external electrodes 5*a* and 5*b*, the Ni films 6*a* and 6*b* and the Sn films 7*a* and 7*b* are sequentially formed by an electroplating method, so that the multilayer positive temperature coefficient thermistor described above is manufactured.

Incidentally, the present invention is not limited to the above embodiment. In the above embodiment, the sintered density of the semiconductor ceramic layer 2 is adjusted by the addition amount of the organic binder when the ceramic green sheets are formed; however, the adjustment is not limited thereto.

In addition, in the above embodiment, as a method for forming the external electrodes 5*a* and 5*b*, although a sputtering method is used, a baking treatment may also be used. That is, after an external electrode conductive paste is applied to the two end portions of the ceramic body 4, baking may be performed at a predetermined temperature (such as 500 to 800° C.), and in this step, this baking may also be performed as a re-oxidation treatment for the ceramic body 4. In addition, besides a sputtering method, another thin-film forming method, such as a vacuum deposition method, may also be used as long as it gives superior adhesion.

In addition, in the above embodiment, although the oxides are used as the starting materials, carbonates or the like may also be used.

In addition, although the multilayer positive temperature coefficient thermistor of the present invention is effectively used for overcurrent protection and temperature detection, the present invention is not only limited thereto. In the multilayer positive temperature coefficient thermistor shown in FIG. 1, the internal electrode layers 3*a* and 3*b* are alternately connected to the external electrodes 5*a* and 5*b*; however, when there is provided at least one set including the internal electrode layers 3*a* and 3*b* which are adjacent to each other with the semiconductor ceramic layer 2 interposed therebetween and which are connected to the external electrodes 5*a* and 5*b* connected to different potentials, other internal electrode layers 3*a* and 3*b* may not always be alternately formed; hence, the present invention in not limited to a multilayer positive temperature coefficient thermistor having the structure shown in FIG. 1.

In addition, among the surfaces of the ceramic body 4, a protective layer, such as a glass layer or a resin layer, (not shown) may be formed on a surface on which the external electrodes 5*a* and 5*b* are not formed, and when the protective layer as described above is formed, the multilayer positive temperature coefficient thermistor is even more reliably protected from the outside environment, so that the degradation in properties caused, for example, by temperature and/or humidity can be suppressed.

Next, examples of the present invention will be described in detail.

EXAMPLE 1

First, as starting materials, $BaCO_3$, $TiO_2$, $La_2O_3$, $CeO_2$, $Pr_6O_{11}$, $Nd_2O_3$, $Pm_2O_3$, and $Sm_2O_3$ were prepared, and these starting materials were weighed so as to obtain a semiconductor ceramic layer having a composition of $(Ba_{0.998}A_{0.002})TiO_3$ (where A indicated La, Ce, Pr, Nd, Pm, or Sm).

Subsequently, after pure water was added to these starting materials, mixing and pulverizing were performed in a ball mill together with PSZ balls, followed by drying. Next, calcination was performed at 1,150° C. for 2 hours, and pulverizing was again performed in a ball mill with PSZ balls, so that a calcined powder was obtained.

Next, after an acrylic acid-based organic binder, an ammonium polycarboxylate salt used as a dispersant, and pure water were added to the calcined powder thus obtained, mixing was performed in a ball mill together with PSZ balls for 15 hours, so that a ceramic slurry was obtained. In this step, the addition amount of the acrylic acid-based binder was adjusted so that the actual-measured sintered density after firing was 75% of the theoretical sintered density.

Subsequently, the ceramic slurry thus obtained was formed into sheets by a doctor blade method, followed by drying, thereby forming ceramic green sheets so that semiconductor ceramic layers after firing had a thickness d of 22 μm.

Next, a Ni powder and an organic binder were dispersed in an organic solvent to form an internal electrode conductive paste. Then, the internal electrode conductive paste thus obtained was applied by screen printing on a primary surface of the ceramic green sheet so that the thickness D of an internal electrode layer after firing was 1.1 μm, thereby forming a conductive pattern. That is, in this example, the thickness of the ceramic green sheet and that of the conductive pattern were adjusted so that the ratio d/D of the thickness d of the semiconductor ceramic layer to the thickness D of the internal electrode layer was set to 0.05 after firing.

Subsequently, after 25 ceramic green sheets provided with the conductive patterns were laminated to each other so that the conductive patterns faced each other with the respective ceramic green sheets interposed therebetween, two sets each including 5 protective ceramic green sheets provided with no conductive patterns were further disposed on the top and the bottom of the above laminate, and cutting was then performed, so that a green laminate having a length of 2.2 mm, a width of 1.3 mm, and a thickness of 0.9 mm was formed. After this green laminate was processed by a de-binding treatment in an air atmosphere at 400° C. for 12 hours, firing was performed at a firing temperature of 1,150° C. for 2 hours in a reducing atmosphere in which the concentration of a $H_2$ gas to that of a $N_2$ gas was adjusted to 3 percent by volume, so that a ceramic body composed of the semiconductor ceramic layers and the internal electrode layers were alternately laminated to each other was obtained.

Next, after the surface of the ceramic body thus obtained was processed by barrel polishing, the ceramic body was immersed in a silica-based glass solution and was then dried. Subsequently, a re-oxidation treatment including a heat treatment was performed at a temperature of 700° C. in an air atmosphere, so that a glass protective layer was formed on the surface of the ceramic body. Next, after barrel polishing was performed on external electrode forming portions of the ceramic body provided with the glass protective layer, a sputtering treatment was sequentially performed on the two end portions of the ceramic body using Cu, Cr, and Ag as a target, thereby forming external electrodes each having a three-layer structure.

Finally, electroplating was performed on the surface of each external electrode to sequentially form a Ni film and a Sn film, so that multilayer positive temperature coefficient thermistors of Sample Nos. 1 to 6 were formed.

Next, 10 multilayer positive temperature coefficient thermistors of each of Sample Nos. 1 to 6 were prepared, and by applying a voltage of 0.01 V at a room-temperature of 25° C.

and a humidity of 60%, a room-temperature resistance (initial value) X (Ω) was measured using a direct-current four terminal method.

Subsequently, after held in a constant-temperature bath at a room temperature of 25° C. and a humidity of 60% for 1,000 hours, the above samples were recovered from the constant-temperature bath, and by again applying a voltage of 0.01 V, a room-temperature resistance X' (Ω) of each sample which was held for 1,000 hours was measured by a direct-current four terminal method. By the following equation (1), a rate ΔX of temporal change in room-temperature resistance was obtained.

$$\Delta X=(X'-X)/X\times 100 \quad (1)$$

Table 1 shows the maximum value, the minimum value, and the average value which were obtained from the 10 samples of each of Sample Nos. 1 to 6.

In this example, as described above, the addition amount of the acrylic acid-based organic binder was adjusted so that the actual-measured sintered density was 75% of the theoretical sintered density, and this actual-measured sintered density was obtained as described below. That is, first, ceramic green sheets provided with no conductive patterns were laminated and were then processed by a firing treatment so as to additionally form a sample used for sintered density measurement, and the actual-measured sintered density was calculated by measuring the volume and the weight of this sample.

TABLE 1

| Sample | | $(Ba_{0.998}A_{0.002})TiO_3$ | | |
|---|---|---|---|---|
| | | Rate ΔX of temporal change in room-temperature resistance (%) | | |
| No. | A | Maximum value | Minimum value | Average value |
| 1 | La | 1.6 | 0.3 | 1.2 |
| 2 | Ce | 1.7 | 0.1 | 1.1 |
| 3 | Pr | 1.8 | 0.6 | 1.4 |
| 4 | Nd | 1.5 | 0.3 | 1.2 |
| 5 | Pm | 1.7 | 0.4 | 1.3 |
| 6* | Sm | 10.7 | 6.3 | 8.0 |

*Out of the range of the present invention.

As apparent from Table 1, according to Sample No. 6, since Sm was used as the semiconductor dopant, the average value of the rate ΔX of temporal change in room-temperature resistance was 8.0%, and even the minimum value was 6.3%; hence it was found that rate ΔX was increased to 6% or more.

On the other hand, according to Sample Nos. 1 to 5, since the specific semiconductor dopants, that is, La, Ce, Pr, Nd, and Pm were used, the average value of the rate ΔX of temporal change in room-temperature resistance was in the range of 1.1% to 1.4%, and hence it was found that rate ΔX could be decreased to 1.5% or less. That is, by the use of the specific semiconductor dopant of the present invention, it was confirmed that the rate ΔX of temporal change in room-temperature resistance could be significantly suppressed.

EXAMPLE 2

As the starting materials, $BaTiO_3$, $TiO_2$, and $CeO_2$, which was used as the semiconductor dopant, were prepared, and these starting materials were weighed so as to obtain a semiconductor ceramic layer having a composition of $(Ba_{0.998}Ce_{0.002})TiO_3$, and subsequently, by using a method and a procedure similar to those of [Example 1], a calcined powder was obtained.

Next, an acrylic acid-based organic binder, an ammonium polycarboxylate salt (dispersant), and pure water were added to the above calcined powder and were then mixed in a ball mill with PSZ balls for 15 hours, so that a ceramic slurry was obtained. In this example, the addition amount of the acrylic acid-based organic binder was adjusted so that the actual-measured sintered density after firing was 60% to 95% of the theoretical sintered density.

Subsequently, multilayer positive temperature coefficient thermistors of Sample Nos. 11 to 18 were formed by using a method and a procedure similar to those of [Example 1].

Next, 10 multilayer positive temperature coefficient thermistors of each of Sample Nos. 11 to 18 were prepared, and by methods similar to those in [Example 1], the room-temperature resistance X and the rate ΔX of temporal change in room-temperature resistance were measured.

In addition, the rate ΔR of resistance change of the multilayer positive temperature coefficient thermistor of each of Sample Nos. 11 to 18 was also obtained. That is, by using 10 multilayer positive temperature coefficient thermistors of each sample, resistance $R_{25}$ at 25° C. and resistance $R_{250}$ at 250° C. were measured by a direct-current four terminal method while a voltage of 0.01 V was applied, and the rate ΔR of resistance change (number of digits) was obtained in accordance with the following equation (2).

$$\Delta R=\log(R_{250}/R_{25}) \quad (2)$$

Table 2 shows the relative value (hereinafter, in Example 2, simply referred to as "sintered density") of the actual-measured sintered density to the theoretical sintered density of each sample, and the average values of the room-temperature resistance X, the rate ΔX of temporal change in room-temperature resistance, and the rate ΔR of resistance change, which were obtained from the 10 thermistors of each sample.

TABLE 2

| | $(Ba_{0.998}Ce_{0.002})TiO_3$ | | | |
|---|---|---|---|---|
| Sample No. | Sintered density (%) | Room-temperature resistance X (Ω) | Rate ΔX of temporal change in room-temperature resistance (%) | Rate ΔR of resistance change (number of digits) |
| 11* | 60 | 3.14 | 1.6 | 3.7 |
| 12 | 65 | 0.671 | 1.2 | 4.1 |
| 13 | 70 | 0.211 | 1.4 | 4.3 |
| 14 | 75 | 0.183 | 1.2 | 4.5 |
| 15 | 80 | 0.143 | 1.2 | 4.7 |
| 16 | 85 | 0.127 | 1.1 | 4.3 |
| 17 | 90 | 0.102 | 2.0 | 4.0 |
| 18* | 95 | 0.067 | 12.7 | 2.1 |

*Out of the range of the present invention.

As apparent from Table 2, according to Sample No. 11, it was found that since the sintered density was too low, such as 60%, the room-temperature resistance was increased to 1Ω or more, such as 3.14Ω.

In addition, according to Sample No. 18, since the sintered density was high, such as 95%, oxygen could not be diffused sufficiently to the central portion during the re-oxidation treatment, so that oxidation irregularities were generated. Hence, as a result, the rate ΔX of temporal change in room-temperature resistance was increased to 12.7%, and further, the rate ΔR of resistance change was decreased to approximately 2 digits. Accordingly, sufficient properties could not be obtained.

On the other hand, according to Sample Nos. 12 to 17, since the sintered density was in the range of 65% to 90%, it was found that the room-temperature resistance X was decreased to the range of 0.102 to 0.671Ω, which was 1Ω or less, the rate ΔX of temporal change in room-temperature resistance could be suppressed to 2% or less, and further the rate ΔR of resistance change was 4 digits or more, that is, a sufficient rate of resistance change could be obtained.

EXAMPLE 3

As the starting materials, $BaTiO_3$, $TiO_2$, and $Nd_2O_3$, which was used as the semiconductor dopant, were prepared, and these starting materials were weighed so as to obtain a semiconductor ceramic layer having a composition of $(Ba_{0.998}Nd_{0.002})_xTi_yO_3$ (where x/y was in the range of 0.996 to 1.008), and subsequently, by using a method and a procedure similar to those of [Example 1], a calcined powder was obtained.

Next, an acrylic acid-based organic binder, an ammonium polycarboxylate salt (dispersant), and pure water were added to the above calcined powder and were then mixed with PSZ balls in a ball mill for 15 hours, so that a ceramic slurry was obtained. In this example, the addition amount of the acrylic acid-based organic binder was adjusted so that the actual-measured sintered density after firing was 80% of the theoretical sintered density.

Subsequently, multilayer positive temperature coefficient thermistors of Sample Nos. 21 to 27 were formed by using a method and a procedure similar to those of [Example 1].

Next, 10 multilayer positive temperature coefficient thermistors of each of Sample Nos. 21 to 27 were prepared, the room-temperature resistance X and the rate ΔX of temporal change in room-temperature resistance were measured by methods similar to those in [Example 1], and the rate ΔR of resistance change was obtained by a method similar to that in [Example 2].

Table 3 shows the ratio x/y of the Ba site to the Ti site of each sample, and the average values of the room-temperature resistance X, the rate ΔX of temporal change in room-temperature resistance, and the rate ΔR of resistance change, which were obtained from the 10 thermistors of each sample.

TABLE 3

| | $(Ba_{0.998}Ce_{0.002})_xTi_yO_3$ | | | |
|---|---|---|---|---|
| Sample No. | x/y | Room-temperature resistance X (Ω) | Rate ΔX of temporal change in room-temperature resistance (%) | Rate ΔR of resistance change (number of digits) |
| 21* | 0.996 | 0.37 | 5.7 | 4.2 |
| 22 | 0.998 | 0.20 | 1.9 | 4.2 |
| 23 | 1.000 | 0.16 | 1.4 | 4.5 |
| 24 | 1.002 | 0.16 | 1.2 | 4.6 |
| 25 | 1.004 | 0.16 | 1.4 | 4.7 |
| 26 | 1.006 | 0.18 | 1.7 | 4.9 |
| 27* | 1.008 | 7.31 | 16.9 | 5.4 |

*Out of the range of the present invention.

As apparent from Table 3, according to Sample No. 21, it was found that since the ratio x/y of the Ba site to the Ti site was less than 0.998, such as 0.996, the rate ΔX of temporal change in room-temperature resistance was increased to 5% or more.

In addition, according to Sample No. 27, it was found that since the ratio x/y of the Ba site to the Ti site was more than 1.006, such as 1.008, the room-temperature resistance X was increased to 7Ω or more, and in addition, the rate ΔX of temporal change in room-temperature resistance was increased to 16.9%.

On the other hand, according to Sample Nos. 22 to 26, it was found that since the ratio x/y of the Ba site to the Ti site was in the range of 0.998 to 1.006, the room-temperature resistance was decreased to 1Ω or less, such as 0.16 to 0.20Ω, the rate ΔX of temporal change in room-temperature resistance was also decreased to 2.0% or less, and the rate ΔR of resistance change was high, such as 4 digits or more, that is, a sufficient rate ΔR of resistance change could be obtained.

EXAMPLE 4

As the starting materials, $BaTiO_3$, $TiO_2$, and $Nd_2O_3$, which was used as the semiconductor dopant, were prepared, and these starting materials were weighed so as to obtain a semiconductor ceramic layer having a composition of $(Ba_{0.998}Nd_{0.002})TiO_3$, and subsequently, by using a method and a procedure similar to those of [Example 1], a calcined powder was obtained.

Next, an acrylic acid-based organic binder, an ammonium polycarboxylate salt (dispersant), and pure water were added to the above calcined powder and were then mixed with PSZ balls in a ball mill for 15 hours, so that a ceramic slurry was obtained. In this example, the addition amount of the acrylic acid-based organic binder was adjusted so that the actual-measured sintered density after firing was 75% of the theoretical sintered density.

Subsequently, the ceramic slurry thus obtained was formed by a doctor blade method into sheets so that the thickness D of the semiconductor ceramic layer after firing was 11 to 40 μm, followed by drying, thereby forming ceramic green sheets.

Next, a Ni powder and an organic binder were dispersed in an organic solvent, so that an internal electrode conductive paste was obtained. Subsequently, the obtained internal electrode conductive paste was applied on a primary surface of the ceramic green sheet by screen printing so as to obtain an electrode thickness of 0.4 to 5 μm after sintering, thereby forming a conductive pattern.

Next, by a method and a procedure similar to those of [Example 1], multilayer positive temperature coefficient thermistors of Sample Nos. 31 to 51 were formed.

Next, 10 multilayer positive temperature coefficient thermistors of each of Sample Nos. 31 to 51 were prepared, and by a method similar to that in [Example 1], the rate ΔX of temporal change in room-temperature resistance was measured.

Table 4 shows the average values of the thickness d of the internal electrode layer, the thickness D of the semiconductor ceramic layer, the ratio d/D thereof, and the rate ΔX of temporal change in room-temperature resistance of each sample.

TABLE 4

| | $(Ba_{0.998}Nd_{0.002})TiO_3$ | | | |
|---|---|---|---|---|
| Sample No. | Thickness d of internal electrode layer d (μm) | Thickness D of semiconductor ceramic layer D (μm) | D/D (-) | Rate ΔX of temporal change in room-temperature resistance (%) |
| 31* | 5 | 11 | 0.45 | 23.7 |
| 32* | 4.3 | 11 | 0.36 | 13.3 |
| 33* | 3.1 | 11 | 0.28 | 13.1 |
| 34* | 2.2 | 11 | 0.20 | 6.1 |
| 35 | 1.1 | 11 | 0.10 | 2.0 |
| 36 | 0.6 | 11 | 0.05 | 1.6 |

TABLE 4-continued

| Sample No. | $(Ba_{0.998}Nd_{0.002})TiO_3$ Thickness d of internal electrode layer d (μm) | Thickness D of semiconductor ceramic layer D (μm) | D/D (-) | Rate ΔX of temporal change in room-temperature resistance (%) |
|---|---|---|---|---|
| 37* | 0.4 | 11 | 0.04 | 9.2 |
| 38* | 5 | 22 | 0.23 | 12.4 |
| 39* | 4.3 | 22 | 0.20 | 5.7 |
| 40 | 3.1 | 22 | 0.14 | 1.8 |
| 41 | 2.2 | 22 | 0.10 | 1.4 |
| 42 | 1.1 | 22 | 0.05 | 1.3 |
| 43 | 0.6 | 22 | 0.03 | 1.7 |
| 44* | 0.4 | 22 | 0.02 | 6.9 |
| 45 | 5 | 40 | 0.13 | 1.6 |
| 46 | 4.3 | 40 | 0.11 | 1.2 |
| 47 | 3.1 | 40 | 0.08 | 1.3 |
| 48 | 2.2 | 40 | 0.06 | 0.3 |
| 49 | 1.1 | 40 | 0.03 | 1.1 |
| 50 | 0.6 | 40 | 0.02 | 1.3 |
| 51* | 0.4 | 40 | 0.01 | 4.5 |

*Out of the range of the present invention.

As apparent from Table 4, according to Sample Nos. 37, 44, and 51, since the thickness d of the internal electrode layer was smaller than 0.6 μm, such as 0.4 μm, the rate ΔX of temporal change in room-temperature resistance became unstable, and hence the average value was increased to 4.5% to 9.2%.

In addition, according to Sample Nos. 31 to 34, 38, and 39, it was found that since the d/D was 0.2 to 0.45, which was 0.2 or more, the rate ΔX of temporal change in room-temperature resistance was increased to 5.7% to 23.7%, and that as the d/D was increased, the rate ΔX of temporal change in room-temperature resistance was increased.

On the other hand, according to Sample Nos. 35, 36, 40 to 43, and 45 to 50, it was found that since the thickness d of the internal electrode layer was 0.6 μm or more, and the ratio d/D of the thickness d of the internal electrode layer to the thickness D of the semiconductor ceramic layer satisfied d/D<0.2, the rate ΔX of temporal change in room-temperature resistance could be suppressed to 2.0% or less, such as 0.3% to 2.0%.

EXAMPLE 5

As the starting materials, $BaTiO_3$, $TiO_2$, $La_2O_3$ and $Sm_2O_3$, the latter two being used as the semiconductor dopant, were prepared, and these starting materials were weighed so as to obtain a semiconductor ceramic layer having a composition of $(Ba_{1-\alpha}A_\alpha)TiO_3$ (where A indicated La or Sm, α was in the range of 0.0008 to 0.008), and subsequently, by using a method and a procedure similar to those of [Example 1], multilayer positive temperature coefficient thermistors of Sample Nos. 61 to 70 were formed.

Next, after 10 multilayer positive temperature coefficient thermistors of each of Sample Nos. 61 to 70 were prepared, the room-temperature resistance X and the rate ΔX of temporal change in room-temperature resistance were measured by methods similar to those in [Example 1], and the rate ΔR of resistance change was measured by a method similar to that in [Example 2].

Table 5 shows the composition of the semiconductor ceramic layer of each sample, and the average values of the room-temperature resistance X, the rate ΔX of temporal change in room-temperature resistance, and the rate ΔR of resistance change, which were obtained from the 10 thermistors of each sample.

TABLE 5

| Sample No. | $(Ba_{1-\alpha}A_\alpha)TiO_3$ A | α | Room-temperature resistance X (Ω) | Rate ΔX of temporal change in room-temperature resistance (%) | Rate ΔR of resistance change (number of digits) |
|---|---|---|---|---|---|
| 61** | La | 0.0008 | 1.24 | 1.3 | 4.7 |
| 62 | La | 0.001 | 0.23 | 1.4 | 4.7 |
| 63 | La | 0.002 | 0.15 | 1.2 | 4.5 |
| 64 | La | 0.003 | 0.09 | 1.6 | 4.2 |
| 65 | La | 0.005 | 0.06 | 1.4 | 4.0 |
| 66** | La | 0.008 | 3.61 | 2.0 | 0.8 |
| 67* | Sm | 0.001 | 3.241 | 9.4 | 3.6 |
| 68* | Sm | 0.002 | 0.492 | 8.0 | 3.2 |
| 69* | Sm | 0.003 | 0.271 | 10.6 | 2.1 |
| 70* | Sm | 0.005 | 0.124 | 15.3 | 1.6 |

*Out of the range of the present invention.
**Out of the range of the present invention (Claim 2).

As apparent from Table 5, according to Sample No. 61, since the content of La as the semiconductor dopant was 0.08 molar parts (α=0.0008), which was less than 0.1 molar parts, with respect to 100 molar parts of Ti, although the rate ΔX of temporal change in room-temperature resistance was low, such as 1.3%, and in addition, the rate ΔR of resistance change was high, such as 4.7 digits, the room-temperature resistance was increased to 1.24Ω, which was 1Ω or more.

In addition, according to Sample No. 66, since the content of La was 0.8 molar parts (α=0.008), which was more than 0.5 molar parts, with respect to 100 molar parts of Ti, although the rate ΔX of temporal change in room-temperature resistance was decreased to 1.3%, it was found that the room-temperature resistance was increased to 3.61Ω, which was 1Ω or more, and the rate ΔR of resistance change was decreased to one digit or less.

According to Sample Nos. 67 to 70, it was found that since Sm, which was out of the range of the present invention, was used as the semiconductor dopant, the rate ΔX of change in room-temperature resistance was increased to 8% or more, and the rate ΔR of resistance change was decreased to less than 4 digits or less.

On the other hand, according to Sample Nos. 62 to 65, since the content of La was 0.001 to 0.005, which was in the range of 0.1 to 0.5 molar parts with respect to 100 molar parts of Ti, it was found that the rate ΔX of temporal change in room-temperature resistance was low, such as 1.2% to 1.6%, a sufficient rate ΔR of resistance change in the range of 4.0 to 4.7 digits could be obtained, and further the room-temperature resistance X could be decreased to 1Ω or less, such as 0.06 to 0.23Ω.

For example, when the results of Sample Nos. 63 and 68 were compared to each other, in the case in which La was used as the semiconductor dopant, it was found that the room-temperature resistance X could be decreased to approximately one third as compared to that in the case in which Sm was used.

That is, when the specific semiconductor dopant of the present invention in the range of 0.1 to 0.5 molar parts is contained with respect to 100 molar parts of Ti, it was found that even when firing was performed at a low temperature of 1,150° C., a multilayer positive temperature coefficient thermistor could be obtained which had a low room-temperature resistance X, a low rate ΔX of temporal change in room-temperature resistance, and a sufficient rate ΔR of resistance change.

In particular, according to Sample Nos. 62 to 64 in which the content of the semiconductor dopant was in the range of 0.1 to 0.3 molar parts with respect to 100 molar parts of Ti, it was found that while superior room-temperature resistance X and rate ΔR of resistance change were obtained, the rate ΔX of temporal change in room-temperature resistance could be further improved.

The invention claimed is:

1. A multilayer positive temperature coefficient thermistor comprising:

a ceramic body in which semiconductor ceramic layers having a sintered density in a range of 65% to 90% of a theoretical sintered density and internal electrode layers are alternately laminated to each other; and external electrodes formed on two end portions of the ceramic body and electrically connected to the internal electrode layers, wherein a $BaTiO_3$-based ceramic material is a primary component in the semiconductor ceramic layers, the ratio of the Ba site to the Ti site is represented by 0.998≦Ba site/Ti site≦1.006, and at least one element selected from the group consisting of La, Ce, Pr, Nd, and Pm is contained as a semiconductor dopant in the semiconductor ceramic layers, and a thickness d of the internal electrode layers and a thickness D of the semiconductor ceramic layers satisfy d≧0.6 and d/D<0.2.

2. The multilayer positive temperature coefficient thermistor according to claim 1, wherein the semiconductor dopant is contained in a range of 0.1 to 0.5 molar parts with respect to 100 molar parts of Ti of the $BaTiO_3$-based ceramic material.

3. The multilayer positive temperature coefficient thermistor according to claim 1, wherein the semiconductor ceramic layers having an actual-measured sintered density in the range of 65% to 90% of the theoretical sintered density.

4. The multilayer positive temperature coefficient thermistor according to claim 1, wherein the internal electrodes comprise a base metal selected from the group consisting of Ni, Cu and alloys thereof.

5. The multilayer positive temperature coefficient thermistor according to claim 1, wherein the ratio of the thickness d of the internal electrode and the thickness D of the semiconductor ceramic layers is between 0.02 and 0.2.

6. A multilayer positive temperature coefficient thermistor comprising:

a ceramic body in which semiconductor ceramic layers and internal electrode layers are alternately laminated to each other; and external electrodes formed on the ceramic body and electrically connected to the internal electrode layers, wherein a $BaTiO_3$-based ceramic material is a primary component in the semiconductor ceramic layers, the ratio of the Ba site to the Ti site is represented by 0.998≦Ba site/Ti site≦1.006, the semiconductor ceramic layers contain a semiconductor dopant in a range of 0.1 to 0.5 molar parts with respect to 100 molar parts of Ti of the $BaTiO_3$-based ceramic material, and a thickness d of the internal electrode layers and a thickness D of the semiconductor ceramic layers satisfy d≧0.6 and d/D<0.2.

7. The multilayer positive temperature coefficient thermistor according to claim 6, wherein the semiconductor ceramic layers have an actual-measured sintered density in the range of 65% to 90% of a theoretical sintered density.

8. The multilayer positive temperature coefficient thermistor according to claim 6, wherein the semiconductor dopant is at least one element selected from the group consisting of La, Ce, Pr, Nd, and Pm.

9. The multilayer positive temperature coefficient thermistor according to claim 6, wherein the internal electrodes comprise a base metal selected from the group consisting of Ni, Cu and alloys thereof.

10. The multilayer positive temperature coefficient thermistor according to claim 6, wherein the ratio of the thickness d of the internal electrode and the thickness D of the semiconductor ceramic layers is between 0.02 and 0.2.

* * * * *